US008511940B2

(12) United States Patent
Hall

(10) Patent No.: US 8,511,940 B2
(45) Date of Patent: Aug. 20, 2013

(54) OFFSHORE SUPPORT STRUCTURE AND ASSOCIATED METHOD OF INSTALLING

(75) Inventor: Rudolph A. Hall, Madisonville, LA (US)

(73) Assignee: Keystone Engineering Inc, Mandeville, LA (US)

( * ) Notice: Subject to any disclaimer, the term of this patent is extended or adjusted under 35 U.S.C. 154(b) by 246 days.

(21) Appl. No.: 12/797,236

(22) Filed: Jun. 9, 2010

(65) Prior Publication Data

US 2011/0135400 A1 Jun. 9, 2011

Related U.S. Application Data

(60) Provisional application No. 61/185,755, filed on Jun. 10, 2009, provisional application No. 61/221,433, filed on Jun. 29, 2009.

(51) Int. Cl.
*E02D 29/00* (2006.01)
*E02D 7/28* (2006.01)

(52) U.S. Cl.
USPC ..... 405/195.1; 405/228

(58) Field of Classification Search
USPC ..... 405/228, 195.1, 203, 204; 52/651.04, 52/651.07–651.09; 248/163.1, 166, 440, 248/188.1
See application file for complete search history.

(56) References Cited

U.S. PATENT DOCUMENTS 3,103,292 A * 9/1963 Shang ..... 220/567
3,429,133 A * 2/1969 Hauber ..... 405/208
3,645,104 A * 2/1972 Hogan ..... 405/208
3,745,777 A * 7/1973 Blenkarn ..... 405/211
3,815,372 A * 6/1974 Mott ..... 405/208

(Continued)

FOREIGN PATENT DOCUMENTS

| | | | |
|---|---|---|---|
| EP | 1 867 790 | A1 | 12/2007 |
| WO | 02/095138 | A1 | 11/2002 |
| WO | 2005/040605 | A1 | 5/2005 |
| WO | 2009/050547 | A2 | 4/2009 |

OTHER PUBLICATIONS

The International Search Report and the Written Opinion of the International Searching Authority with mailing date of Nov. 25, 2010; International Application No. PCT/US2010/037963.

*Primary Examiner* — John Kreck
*Assistant Examiner* — Kyle Armstrong
(74) *Attorney, Agent, or Firm* — Studebaker & Brackett PC

(57) ABSTRACT

A support structure for an offshore device and a method of assembling and installing the support structure, is provided including a vertical guide sleeve having, three elongated guide sleeves positioned around the vertical guide sleeve, and various braces connecting the elongated sleeves and the vertical guide sleeve. The support structure also includes a transition joint including a cylindrical portion for connection to an offshore device, such as a support tower of a wind turbine assembly, and a convex portion connected to the vertical guide sleeve. The transition joint may include a strengthening material in contact with an inner surface. The vertical sleeve, elongated sleeves, braces, and transition joint can be assembled onshore with lower piles installed in the elongated sleeves, this guide portion of the structure transported to the offshore location, and then piles driven to secure the structure to the floor of a body of water. The support structure minimizes the costs and time associated with material, assembly, and installation, while possessing sufficient strength, and effectively and efficiently handling and transferring loads from the wind turbine to the support surface throughout operation and while maintaining excellent fatigue resisting characteristics to withstand the extensive cyclic loading induced by the wind and waves.

12 Claims, 13 Drawing Sheets

(56) References Cited

U.S. PATENT DOCUMENTS

| | | | | |
|---|---|---|---|---|
| 4,453,859 | A * | 6/1984 | Sedillot et al. | 405/202 |
| 4,818,145 | A * | 4/1989 | Carruba | 405/203 |
| 4,824,291 | A * | 4/1989 | Coppens | 405/204 |
| 4,966,496 | A * | 10/1990 | Stelzer, Jr. | 405/227 |
| 5,051,036 | A * | 9/1991 | Gomez De Rosas et al. | 405/227 |
| 5,127,767 | A * | 7/1992 | Plagborg-Moller | 405/227 |
| 6,299,385 | B1 * | 10/2001 | Barnes | 405/227 |
| 2006/0115364 | A1 * | 6/2006 | Hall et al. | 416/244 R |
| 2006/0237600 | A1 * | 10/2006 | Hall et al. | 248/188.7 |
| 2007/0269272 | A1 * | 11/2007 | Kothnur et al. | 405/195.1 |

* cited by examiner

OFFSHORE SUPPORT STRUCTURE AND ASSOCIATED METHOD OF INSTALLING

BACKGROUND

1. Technical Field

This invention generally relates to structures used to support offshore components. In particular, this invention relates to support structures for, for example, offshore wind turbines, or the like.

2. Description of the Related Art

Conventional offshore support structures have deck legs that are vertical or are battered outward as they extend downwards. Various conventional arrangements provide sufficient structurally support for the deck and offshore device but the associated dimensions of structures result in high material and installation expense. Wind turbines have traditionally been supported on mono-piles when placed offshore. However, recently, efforts include positioning wind turbines in deeper water (approximately six to seven or more miles offshore) in part to increase the aesthetics of the view from the shoreline. However, with the movement of wind turbines further offshore, the employment of mono-piles as the base on which wind turbines are placed has become less cost effective.

Jacket type foundations or support structures with driven pipe piles have been used to support offshore wind turbines in recent years as the offshore wind industry has considered deeper water sites not previously considered feasible for monopile or gravity type foundations based on the added cost. As turbines grew in size to generate more power, the complexity and weight of the transition piece, located between the lower supports and the wind turbine tower, increased. This joint is typically a cast, forged, or heavy wall steel welded connection manufactured during the onshore fabrication phase of construction. The fabrication and installation of heavy wall joints can be a significant cost component to the wind turbine foundation.

SUMMARY OF THE INVENTION

An embodiment consistent with the claimed inventions includes a support structure for supporting an offshore device, comprising a vertical member having a vertical longitudinal axis and at least three elongated elements positioned around the vertical member. Each of the elongated elements includes a distal end and a proximal portion, wherein the proximal portion is positioned closer to the vertical member than the distal end. The structure further includes a transition joint including a cylindrical portion and a convex portion, wherein the convex portion is connected to the vertical member. The structure also includes at least three upper angled braces each connected at a first end to a respective one of the elongated elements and connected at a second end to the convex portion.

The second end of each of the at least three upper angled braces may include an outer circumferential extent connected to the convex portion around an entire circumference of the outer circumferential extent. The at least three elongated elements may include only three elongated elements offset from each other by 120 degrees around the vertical member. The convex portion may be semispherical. The support structure may further include at least three upper lateral braces each connected at a first end to a respective one of the elongated elements and at a second end to the cylindrical portion. The convex portion may include an outer convex surface, wherein each of the at least three angled braces includes an outer brace surface, and the outer convex surface and the outer brace surface form an angle of at least 30 degrees at connection of the respective angled brace and the convex surface. Each of the at least three angled braces extend along a longitudinal brace axis forming a brace support angle of no greater than 40 degrees from the vertical longitudinal axis. The transition joint may be hollow and may include an inner surface and a strengthening material in contact with the inner surface. The strengthening material may be concrete, such as composite steel concrete, that is, shotcrete. The support structure may further include an offshore wind turbine device mounted on the transition joint.

Another embodiment consistent with the claimed inventions includes a support structure for supporting an offshore device, comprising a vertical member having a vertical longitudinal axis, a transition joint including a cylindrical portion and a convex portion connected to the vertical member; and at least one angled brace connected at one end to the convex portion.

Another embodiment consistent with the claimed inventions includes a method of assembling and installing a support structure for supporting an offshore device at an offshore location, comprising connecting a transition joint to a vertical sleeve member at an onshore location, wherein the transition joint includes a cylindrical portion and a convex portion, and the convex portion is connected to the vertical sleeve member. The method also includes connecting at least three elongated sleeve elements to the vertical sleeve member, at the onshore location, using at least three angled braces; inserting and temporarily connecting a lower pile into each of the at least three elongated sleeve elements at the onshore location to form a support structure; and transporting the support structure, with inserted lower piles, from the onshore location to the offshore location. The method also includes driving a vertical caisson into a support surface at the offshore location to secure the vertical caisson in a vertical support position; lowering the support structure onto the vertical caisson with the vertical caisson extending into the vertical sleeve member; disconnecting each lower pile section from the respective elongated sleeve element; driving each lower pile section through the respective elongated sleeve into the support surface; inserting an upper pile section into each of the at least three elongated sleeve elements; and securing each upper pile section to the respective lower pile section. The driving of each lower pile section may occur after the inserting of the respective upper pile section, and the method may further include applying a driving force to each of the upper pile sections to cause each upper pile section to drive a respective lower pile section into the support surface.

DETAILED DESCRIPTION OF THE INVENTION

Figure 1:
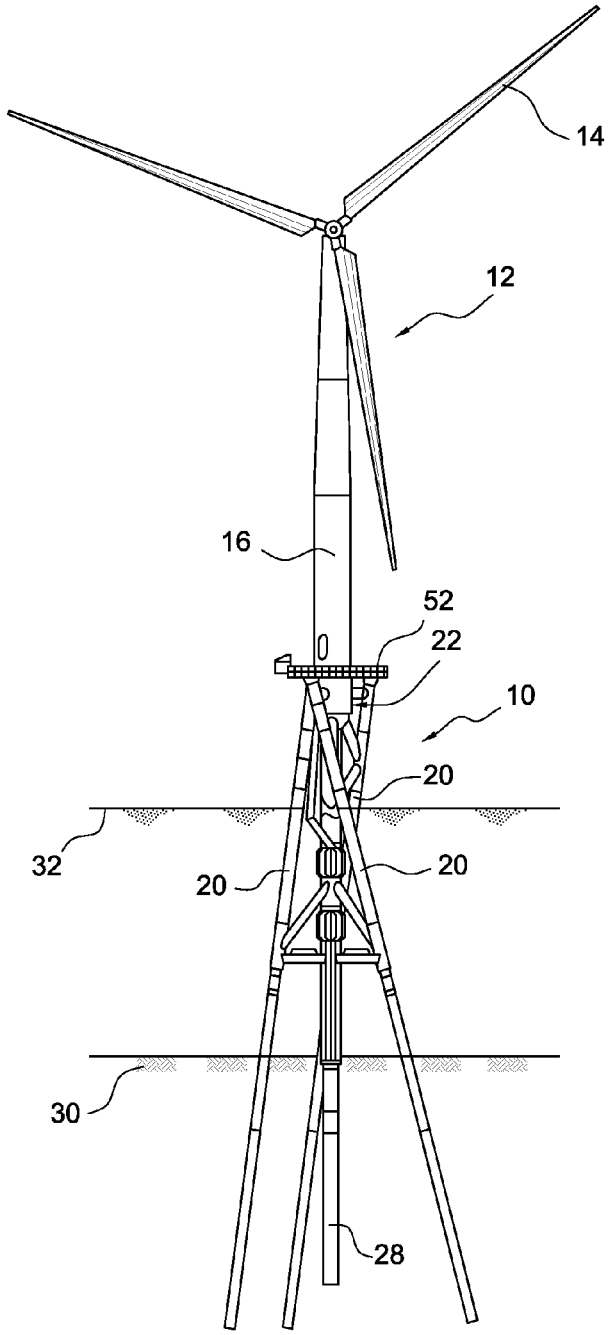
FIG. 1 is a side elevation view of an exemplary embodiment of the support structure and wind turbine.
Figure 2B:
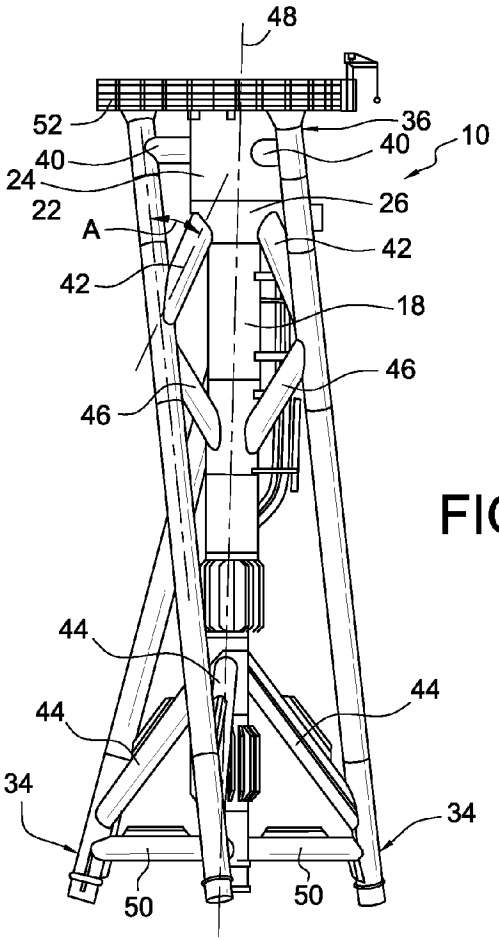
FIGS. 2*a* and 2*b* are side elevation views of different sides of the guide portion of the support structure of FIG. 1.
Figure 2A:
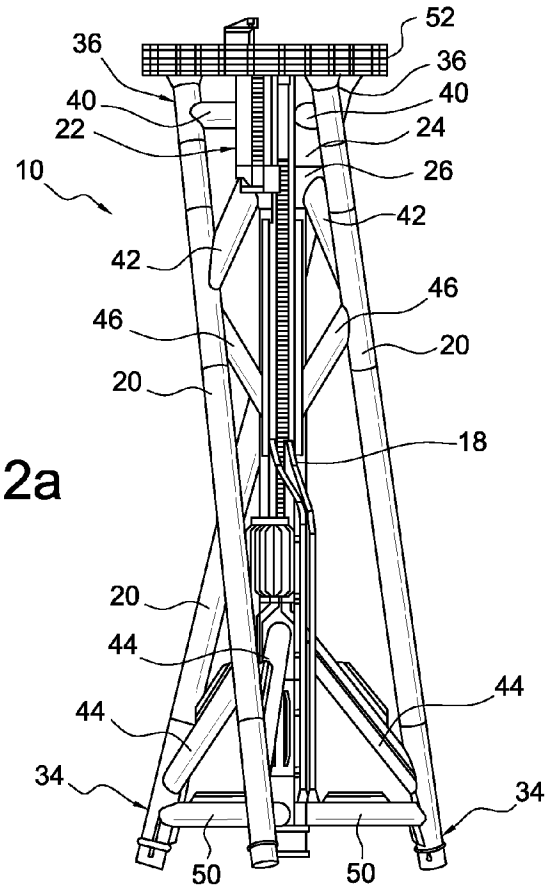
Figure 4:
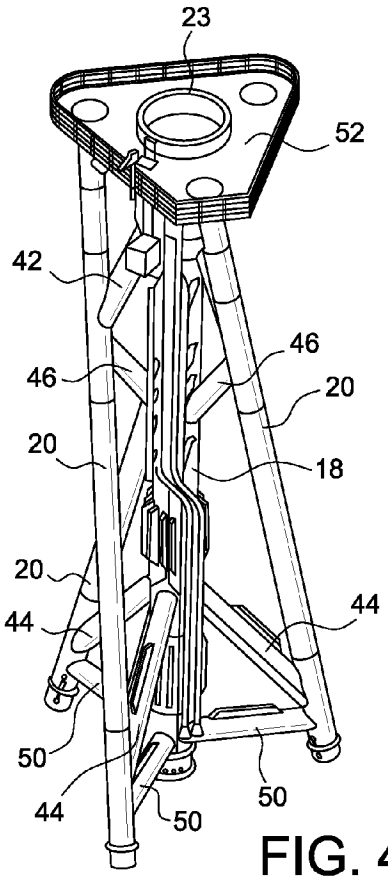
FIG. 4 is a perspective view of the support structure of FIGS. 2*a* and 2*b;*
Figure 3B:
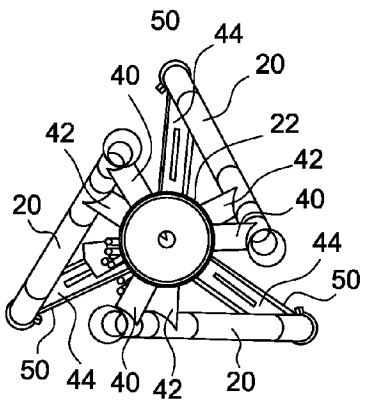
FIGS. 3*a* and 3*b* are top views of the support structure of FIGS. 2*a* and 2*b* with and without a platform, respectively.
Figure 3A:
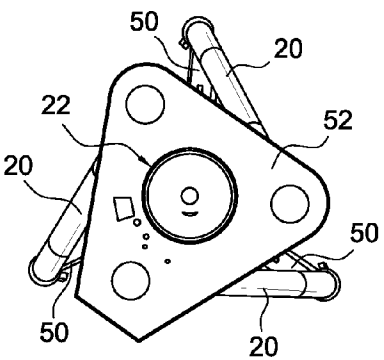

An exemplary embodiment of a support structure, and a method of assembling and installing the support structure, for supporting an offshore device, such as a wind turbine, including a transition joint having a convex portion, will be described in relation to an offshore wind turbine. Of course, the support structure may be used to support other offshore devices such as oil and/or gas drill platforms. To avoid unnecessarily obscuring the exemplary embodiments, the following description omits details of well known structures and devices that may be shown in block diagram form or otherwise summarized. For the purpose of explanation, other numerous specified details are set forth in order to provide a thorough understanding of the exemplary embodiments. It should be appreciated that the exemplary embodiments may be practiced in a variety of ways beyond these specified details. For example, the systems and methods of the exemplary embodiments can be generally expanded and applied to connections with larger or smaller diameter components and transition joints. Furthermore, while exemplary distances and scales are shown in the figures, it is to be appreciated the system and methods in this invention can be varied to fit any particular implementation.

Referring to FIGS. 1-4, a support structure 10 in accordance with an exemplary embodiment is shown in combination with a wind turbine assembly 12 including blades 14 and a support tower 16. Support structure 10 may be generally referred to as the inward battered or twisted jacket type. In the exemplary embodiment, support structure 10 includes a vertical guide member or sleeve 18 having a vertical longitudinal axis 48, three elongated guide elements or sleeves 20 positioned around vertical member 18, and various braces connecting elongated sleeves 20 and vertical sleeve 18. Support structure 10 also includes a transition joint 22 including a cylindrical portion 24 for connection to an offshore device, such as support tower 16 of wind turbine assembly 12, and a convex portion 26 connected to vertical sleeve 18. The combination of vertical sleeve 18, elongated sleeves 20, various braces described hereinbelow, and transition joint 22 form a guide portion of support structure 10. The guide portion is mounted on a vertical caisson 28 driven into a support surface 30, i.e., the ocean floor, and pile section are then driven into support surface 30 positioned below a water line 32. Support structure 10 minimizes the costs and time associated with material, assembly (manufacture), and installation, while possessing sufficient strength, and effectively and efficiently handling and transferring loads from wind turbine 12 to support surface 30 throughout operation and while maintaining excellent fatigue resisting characteristics to withstand the extensive cyclic loading induced by the wind and waves.

Each of elongated sleeves 20 includes a distal end or portion 34 and a proximal portion 36 positioned closer to vertical guide sleeve 18 than distal end 34. The three elongated guide sleeves 20 are positioned 120 degrees apart around vertical sleeve 18 and thus with their distal ends 34 are offset from each other by 120 degrees. Each sleeve 20 extends from the distal end 34 towards proximal portion 36 at an angle from a longitudinal axis 48 to create a twisted shape. Each sleeve 20 also extends towards vertical guide sleeve 18 so that proximal portion 36 is positioned closer to vertical guide sleeve 18 than distal end 34 as clearly shown in FIGS. 3*a* and 3*b*. Each sleeve 20 is connected to transition joint 22 by at least one upper lateral brace 40 connected, i.e. welded, at a first end to a respective sleeve 20 and at a second end to cylindrical portion 26 of transition joint 22. Each sleeve 20 is also connected to transition joint 22 by at least one upper angled brace 42 connected, i.e. welded, at a first end to a respective sleeve 20 and at a second end to convex portion 24 of transition joint 22. In the exemplary embodiment, two additional sets of angled braces are also used to connect vertical sleeve 18 and elongated sleeves 20. Specifically, lower angled braces 44 are each connected at one end to a respective guide sleeve 20 and extend upwardly to connect to vertical sleeve 18 at a second end. Also, middle angled braces 46 are each connected at one end to a respective sleeve 20 and extend downwardly to connect to vertical sleeve 18 at a second end. In addition, a set of lower lateral braces 50 may be provided wherein each lower lateral brace 50 is connected at one end to a respective sleeve 20 adjacent distal end 34 and connected to vertical guide sleeve 20 at a second end. Preferably upper and lower lateral braces 40, 50 extend substantially perpendicular to longitudinal axis 48. Thus the only lateral braces are positioned at opposite ends of structure 10 while only angled braces are positioned between the lateral braces. A platform 52 may be connected at the proximal ends of sleeves 20, and other appurtenances such as ladders, stairs, conduits for electrical cables, etc may also be attached to and supported by structure 10. For example, a lower J-tube assembly 54 may be supported on vertical guide sleeve 20.

Figure 5:
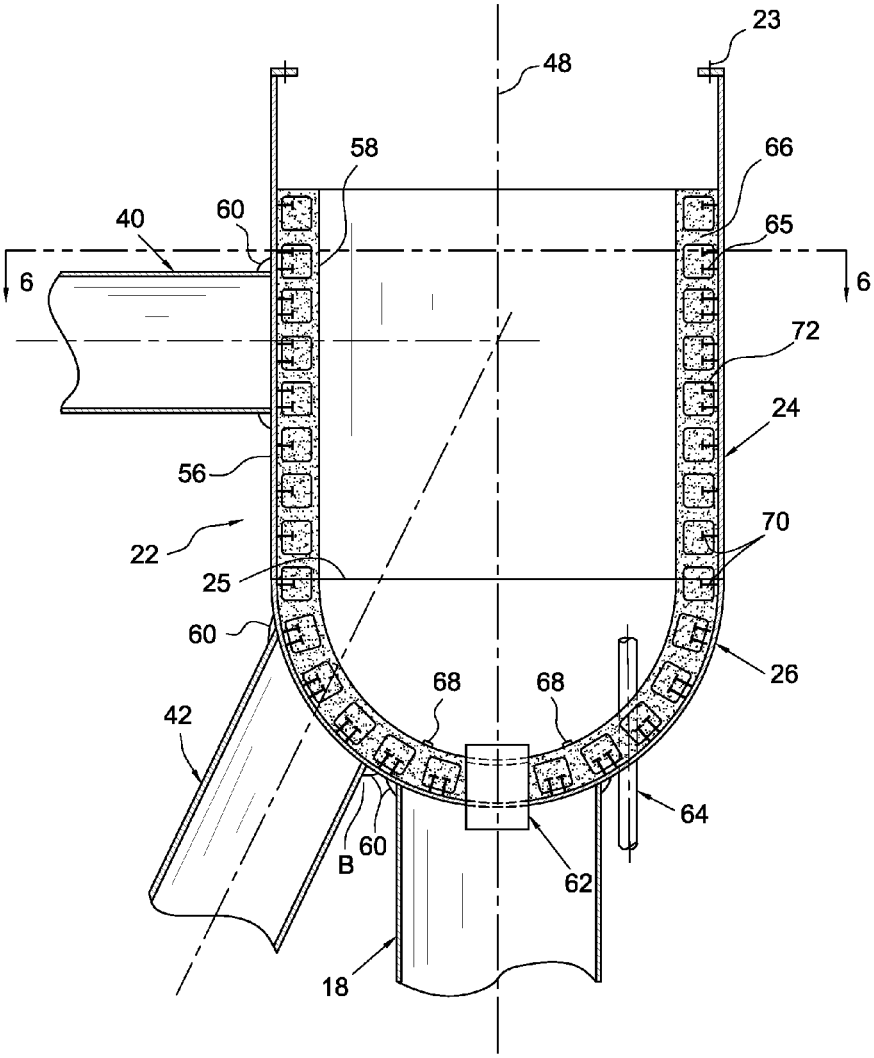
FIG. 5 is a cut away view in elevation of an exemplary embodiment of the concrete reinforced transition joint.
Figure 6:
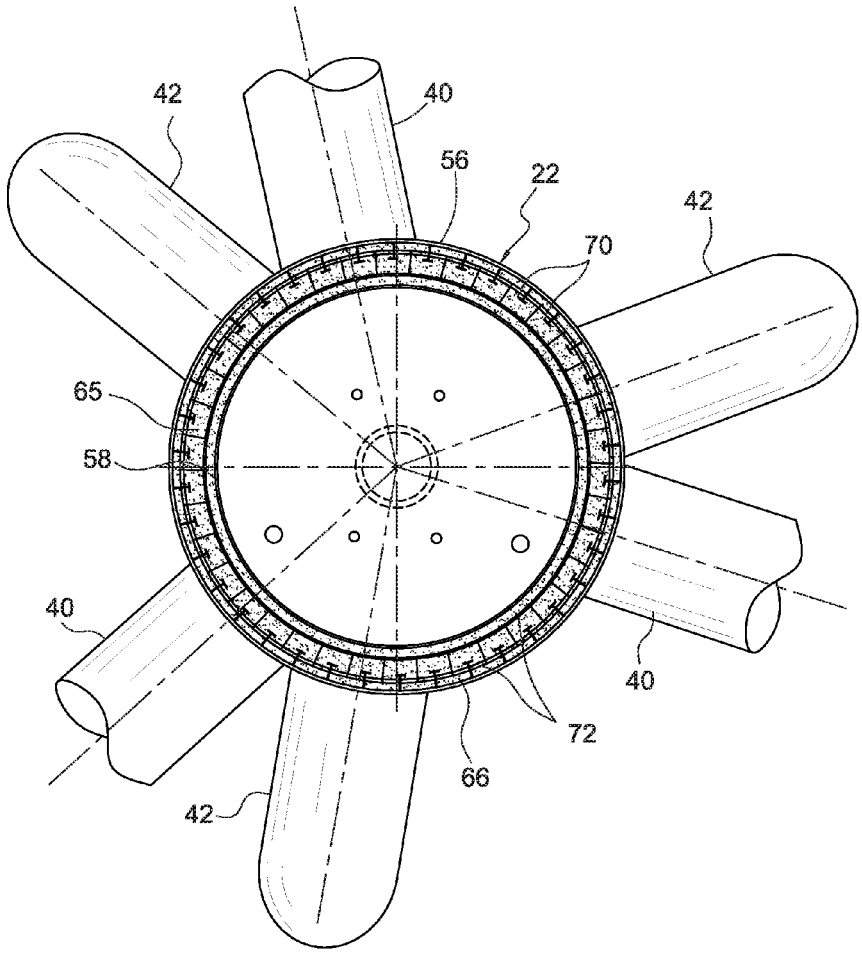
FIG. 6 is a plan cut away cross-sectional view of the concrete reinforced transition joint taken along plane 6-6 in FIG. 5.

FIGS. 5 and 6 show an exemplary embodiment of transition joint 22 including convex portion 26 and cylindrical portion 24 butt welded to one another at interface 25. Preferably, transition joint 22 includes a strengthening material, i.e. concrete, applied to the inner surface of the outer shell as explained hereinbelow. However, in other embodiments, when combined with other inventive aspects of the support structure described herein, transition joint 22 may avoid the use of a strengthening material. In an exemplary embodiment, transition joint 22 is a hollow shell having a strong outer shell or wall 56 formed of a high strength material such as steel, and an inner shell or wall 58 formed of a lightweight material, such as fiberglass or resin. Transition joint 22 includes a mating flange 23 on the top end to connect with a tower base flange of the support tower 16. As shown, weldments 60 created by welding the components together, are used to connect upper lateral braces 40 to outer shell 56 of cylindrical portion 24, and to connect upper angled braces 42 and vertical sleeve 18 to outer shell 56 of convex portion 26. It should be noted that convex portion 26, and specifically its outer surface, is preferably semispherical in shape but could be any other convex shape such as ellipsoidal. An access manway 62 is located at the base or bottom of joint 22 and extends through, and is welded to, both outer shell 56 and inner wall 58 to provide personnel access inside vertical sleeve 18. Access manway 62 also serves as a centralizer for the lightweight inner shell 58. Passages for sleeves and/or risers 64 may be formed through the outer shell 56 and lightweight inner shell 58 to allow for electrical cables and mechanical lines. A strengthening material, such as concrete, 65 is pumped into an annulus or annular cavity 66 formed between outer shell 56 and inner shell 58. Pumping and testing ports 68 allow for pumping and sampling of overflow concrete. Retrieved concrete samples can then be transferred to test cylinders for later verification of concrete strength. Other strengthening materials may be used, such as grout or resin based synthetic mixtures. However, concrete, and forms of concrete such as shotcrete, are particularly advantageous given that such is readily available, inexpensive, provides enhanced strength, and is easy to handle and apply.

Steel studs 70 may be welded to the inner surface of outer shell 56. Studs 70 transmit forces between outer shell 56 and inner shell 58 to reinforced concrete 65 in annulus 66. Steel reinforcing bar (rebar) cages 72 may also be installed throughout annulus space 66. Steel studs 70 are staggered between rebar cages 72. Heavier rebar cages 72 and additional steel studs 70 may be installed near joints where stress concentrations occur. In another exemplary embodiment, no studs are provided.

Figure 7A:
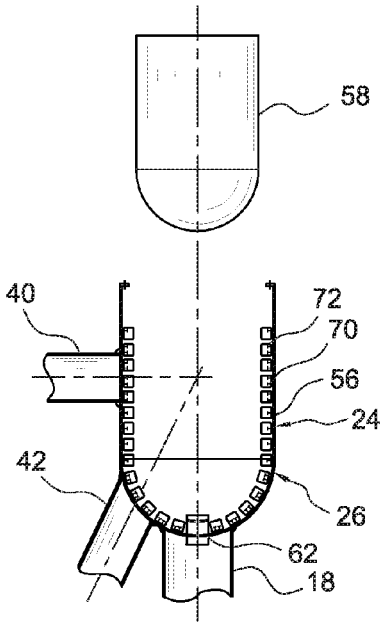
FIG. 7*a*-7*d* are a series of views in side elevation showing the method of lifting, inserting, mating the lightweight inner shell with the outer shell, and installing concrete in the annulus between the shells.
Figure 7B:
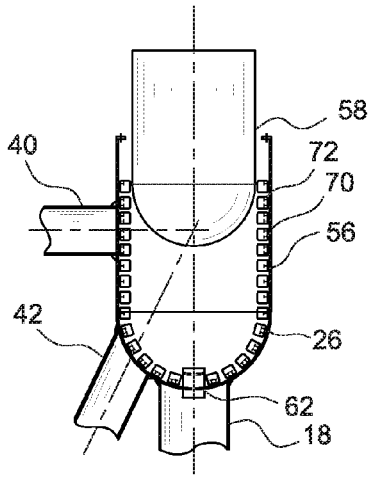
Figure 7C:
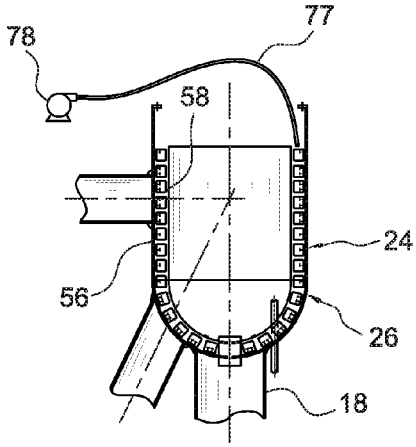
Figure 7D:
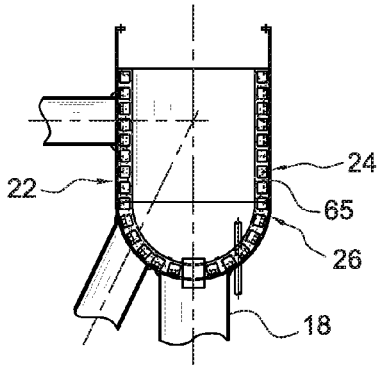
Figure 8:
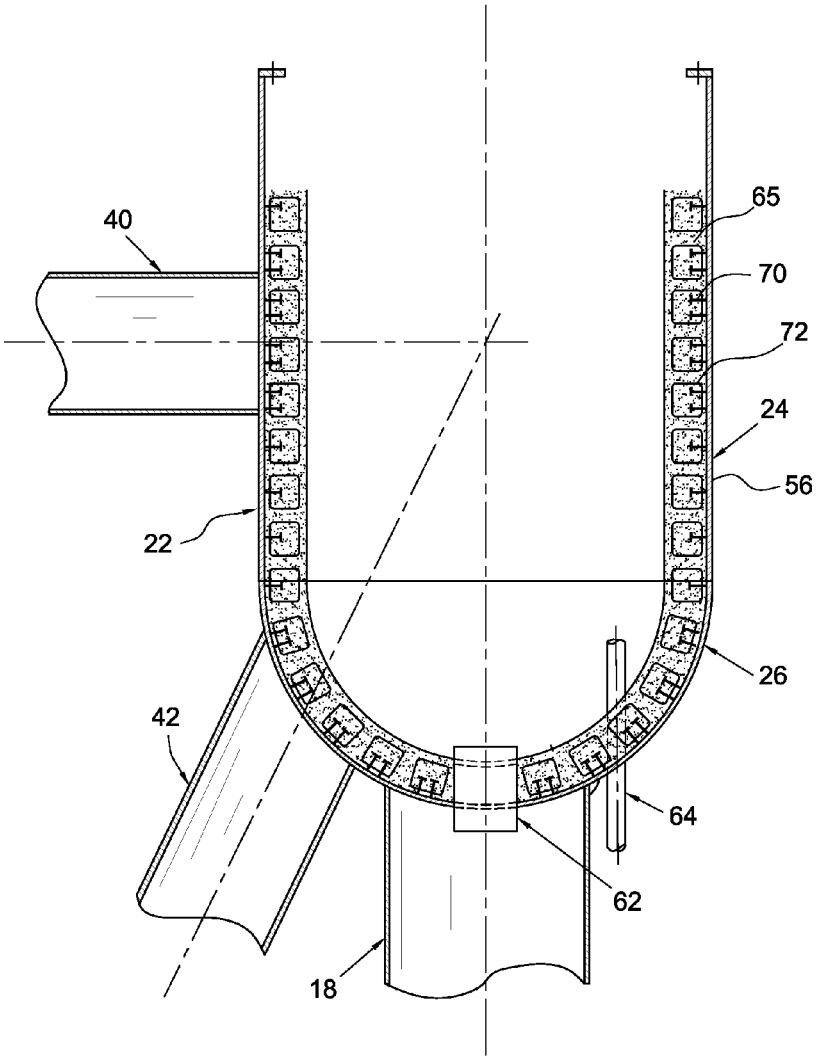
FIG. 8 is a cut away cross-sectional view in elevation of another exemplary embodiment of the concrete reinforced transition joint utilizing a temporary inner shell.

FIGS. 7*a*-7*d* illustrate the stages of an exemplary concreting process. The lightweight internal shell 58 is lifted (FIG. 7*a*) above the outer shell 56. The access manway 62 is welded to the outer and inner shells 56, 58. The rebar cages 72 are installed on the inner surface of outer shell 56. In FIG. 7*b*, the lightweight inner shell 58 is lowered into outer shell 56. The access manway 62 acts as a centralizer and temporary support for the lightweight inner shell 58. The lightweight inner shell 58 is in final assembly position in FIG. 7*c* and is seated on access manway 62. A concrete supply line 76 is connected to a concrete pump 78 to pump concrete from a supply source through concrete line 76 to annulus space 66. Concrete is distributed thru the annulus (FIG. 7*d*) and samples may be collected thru the concrete pumping and sampling ports 68. After a precalibrated amount of concrete is pumped, concrete pump 78 is shut down and the concrete line assembly 76 is retracted.

Figure 9A:
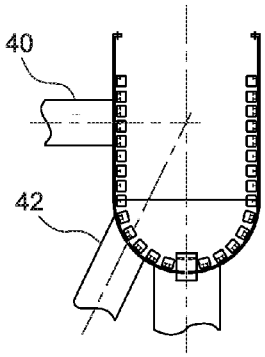
FIGS. 9*a*-9*d* are a series of views in side elevation showing the method of constructing the temporary inner shell inside the outer shell, installing concrete, and removing the temporary inner shell.
Figure 9B:
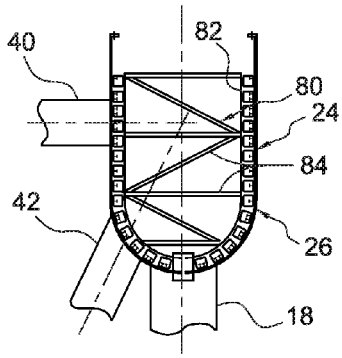
Figure 9C:
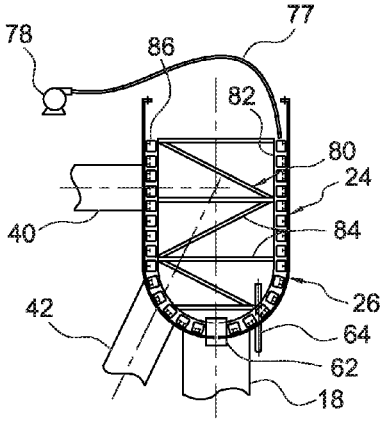
Figure 9D:
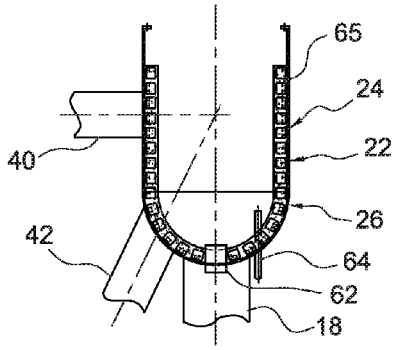

FIGS. 8 and 9*a*-9*d* depict another exemplary embodiment of transition joint 22 which is similar to the previous embodiment except for the lack of an inner shell or wall. FIGS. 9*a*-9*d* depict a series of stages of the concreting process. As shown in FIG. 9*a*, access manway 62 is welded to the inner surface of outer shell 56 and rebar cages 72 are installed inside. Access manway 62 acts as a centralizer and temporary support for a temporary framework 80 constructed inside outer shell 56 as shown in FIG. 9*b*. Temporary framework 80 includes a temporary shell 82 and temporary braces 84 installed to maintain rigidity of the shell 82 during the concrete pumping process. The concrete line 76 is connected to concrete pump 78 and concrete is then pumped into an annulus space 86 formed between outer shell 56 and temporary shell 82. Concrete is distributed thru annulus space 86 in contact with the inner surface of outer shell 56. Concrete samples may be collected thru the concrete testing ports 68. After a precalibrated amount of concrete is pumped, concrete pump 78 is shut down and the concrete line assembly 76 is retracted. After concrete is allowed to set, the temporary framework 80 including temporary inner shell 82 and temporary braces 84 may be removed from the structure. The temporary framework may be formed of fiberglass, steel, wood, or other materials.

The shape of transition joint 22, in particular the convex shape, in combination with the braces connected to joint 22, offer very effective force distribution and transmission allowing full forces and moments, developed in wind turbine tower assemblies during operation and extreme loading events, to be transmitted to the substructure, i.e. piles, and support surface. These benefits are further enhanced by using the twisted sleeve formation and other bracing. Further, using a strengthening material in transition joint 22 decreases the amount of steel needed to form joint 22 thereby greatly reducing weight and costs while maintaining the required strength of an otherwise heavier, more expensive joint.

The concrete reinforced convex transition joint 22 for offshore tubular applications offers an improved structure and method of connecting a wind turbine to the substructure of a driven or suction type pipe pile foundation that can significantly reduce the time and material required for joining the wind turbine to the substructure compared to other conventional methods. The design of transition joint 22 maximizes fatigue performance, stiffness, and load transfer while minimizing cost and fabrication time. The weight of transition joint 22 also provides improved natural frequency compared to other types of substructures for wind turbine pile foundations.

The use of a strengthening material increases the effective thickness of the convex portion and the cylindrical portion so that it is much greater than the actual amount of steel located in a typical cross section, by utilizing the strength of concrete, or the concrete and reinforcing steel, in contact with the outer shell. Concrete can be easily installed with a conventional concrete pump connected to a concrete line to allow concreting of the annulus space between the lightweight or temporary inner shell and the outer shell. Alternatively, in yet another exemplary embodiment, shotcrete may be simply sprayed onto the inner surface of the outer shell with rebar in place, but without steel studs, and without the need for an inner shell. Encasing the reinforcing concrete inside the steel outer spherical/cylindrical shell, with or without an inner shell, provides protection to the concrete from water, salt spray, reinforcement corrosion and other environmental effects which would reduce the durability of the concrete or steel reinforcement.

The convex shell design at the base of transition joint 22 allows for greater flexibility in locating braces and transition attachments to the transition joint. Traditionally, welded brace angles had to be at least 30 degrees between the outer surfaces of the support members forming a welded tubular joint connection to permit welding access around the circumference of support members to create an effective weldment. Applicant has recognized that the optimum angle A between the centerline of the braces and the elongated sleeve is approximately 30 degrees to provide optimum strength, stability, stiffness, and fatigue resistance while avoiding resonance. However, when setting angle A at approximately 30 degrees, the included welded surface angle between the outer surface of the upper angled brace and the outer surface of the convex portion at the connection of the brace and a conventional tubular or conical transition joint would be less than the required 30 degrees. The convex shape of outer shell 56 of transition joint 22 consistent with the claimed invention, creates a welded surface angle of at least 45 degrees since the convex shape of the outer shell 56 extends away from the outer surface of upper angled brace 42 thereby creating plenty of space to weld effectively around the entire circumference of the interface between the components while also maintaining angle A at approximately 30 degrees to create optimum stiffness, strength, and fatigue resistance of the welds, without producing stress concentrations, and to maximize the reduction of the natural frequency of the entire structural system. Thus, the convex shape of convex portion 26 allows upper angled braces 42 to be arranged about transition joint 22 to reduce the natural frequency of the entire structural system to avoid resonance.

The concrete reinforced transition joint 22 provides the full strength and resistance to fatigue damage required for offshore device support and operation while minimizing construction costs. The transition joint 22 transfers the forces and moments, generated by gravity and the aerodynamic response of the wind turbine and the wind turbine supporting tower, from the tower base flange to the support structure members for dissipation into the surrounding soils. The concreted shell designs increase the effective thickness of the joint without use of additional heavy wall steel material. The convex portion of the connection allows greater flexibility in brace angle and location. Steel reinforcement such as rebar is preferably used with concrete. In other embodiments, a stud arrangement on the inner surface of the outer shell may be used to ensure adequate positioning of the strengthening material on the outer shell.

Figure 10A:
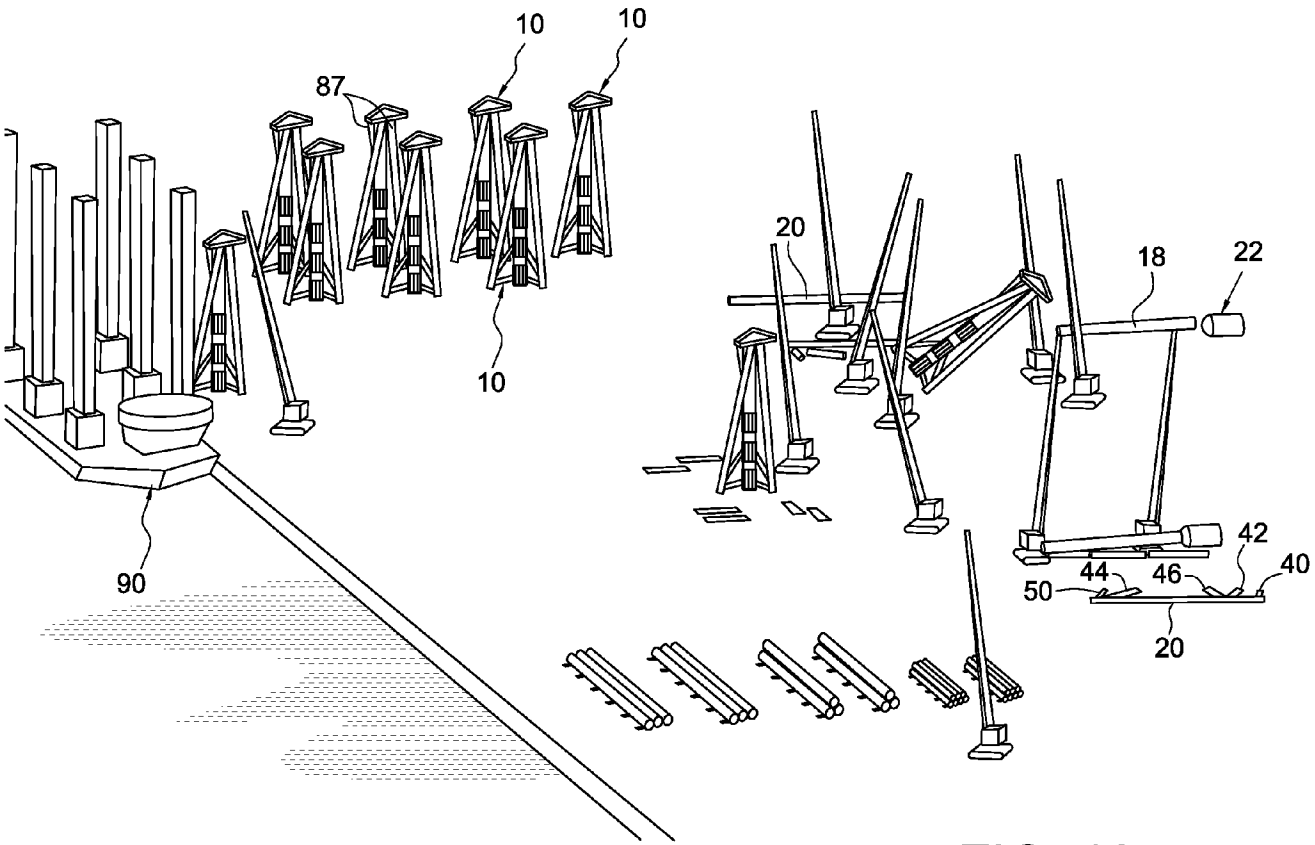
FIG. 10*a* is a overhead perspective view of the onshore location showing an exemplary embodiment of a method assembling the support structure of FIGS. 2*a*-2*b* including lower pile sections.
Figure 10C:
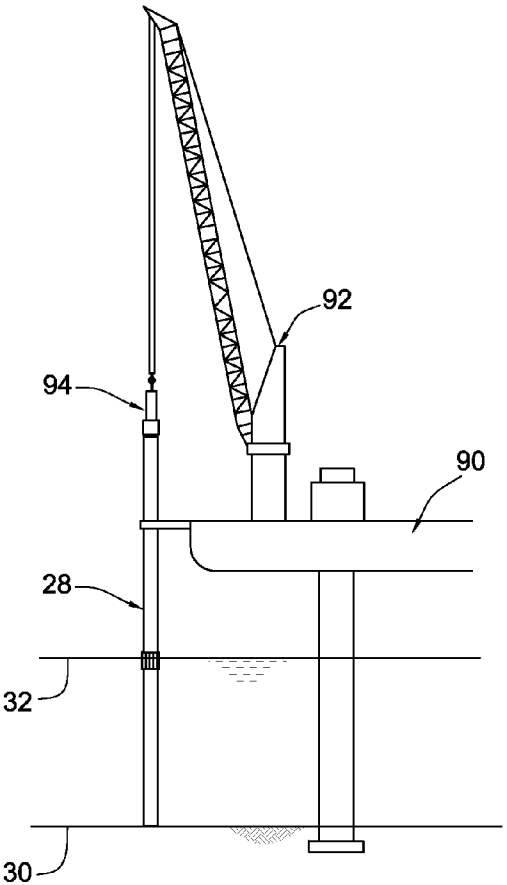
FIGS. 10*b*-10*i* are a series of side elevation views showing an exemplary embodiment of a method of installing the assembled support structure of FIG. 10*a* at an offshore location.
Figure 10B:
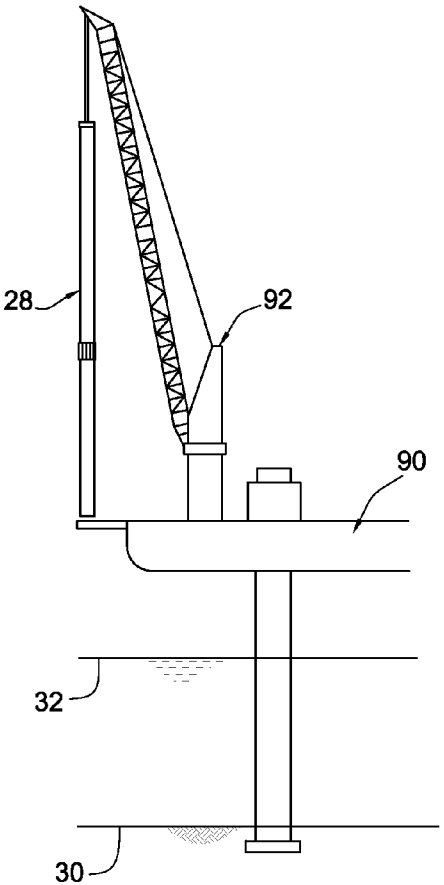
Figure 10E:
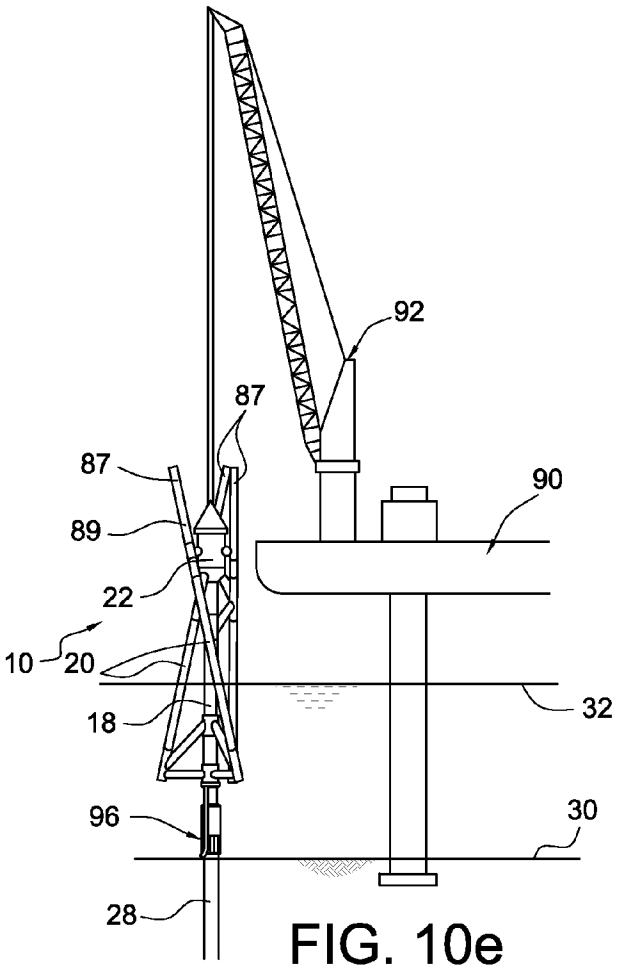
Figure 10D:
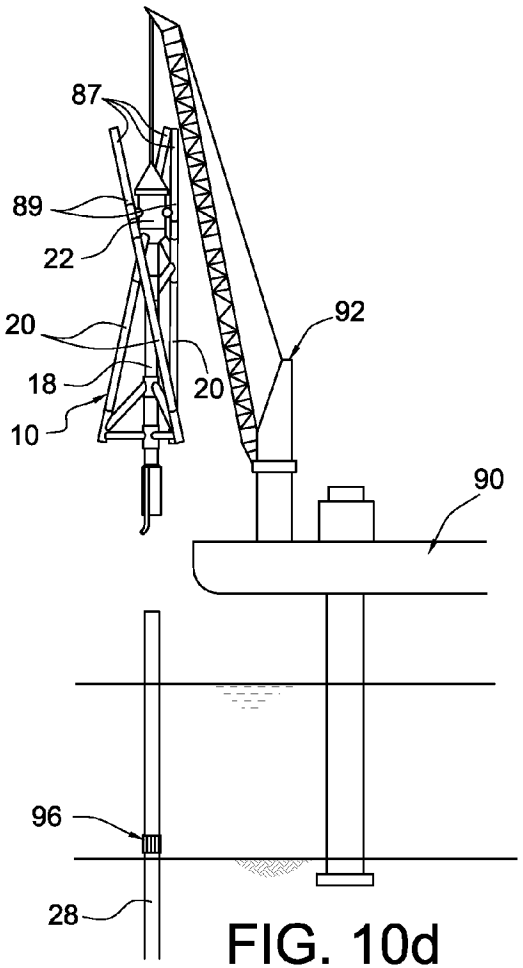
Figure 10G:
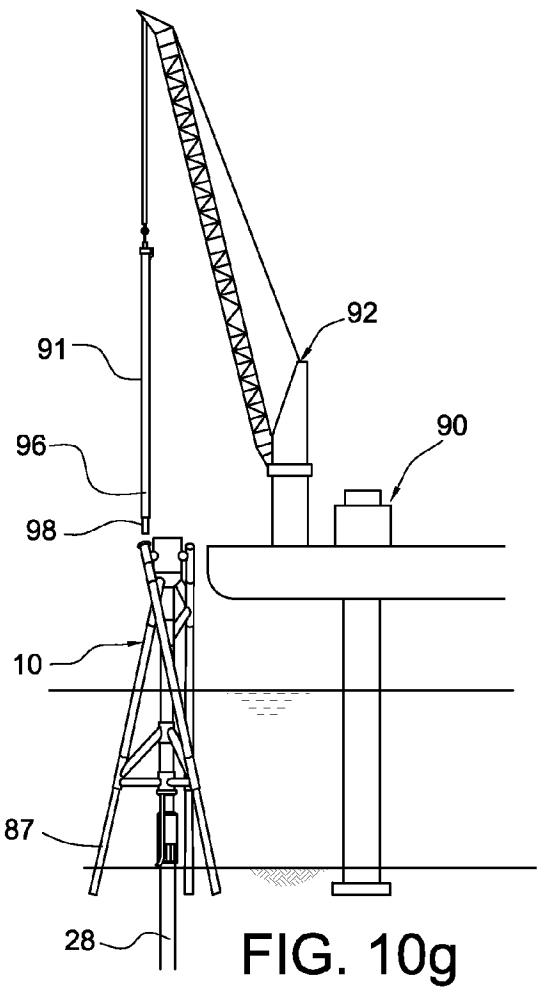
Figure 10F:
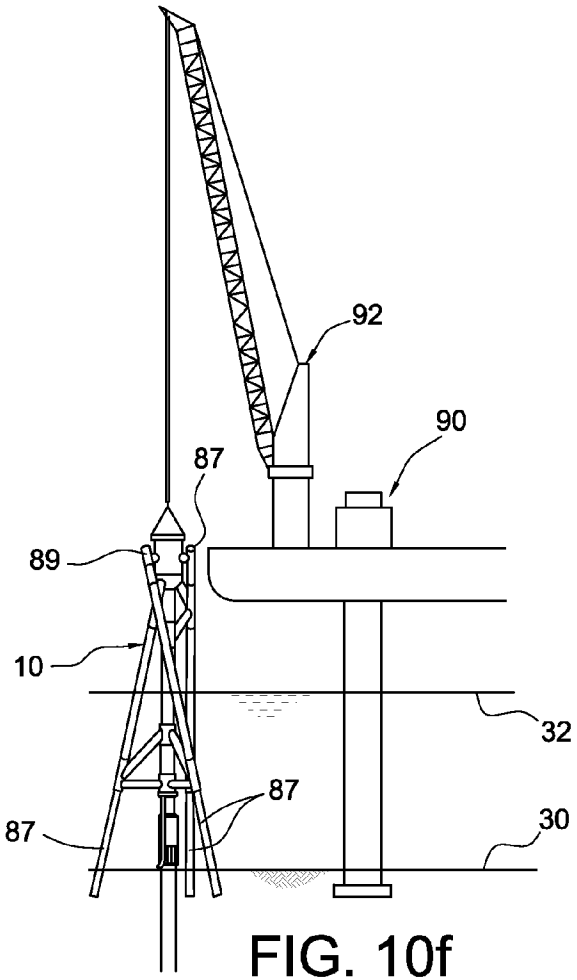
Figure 10I:
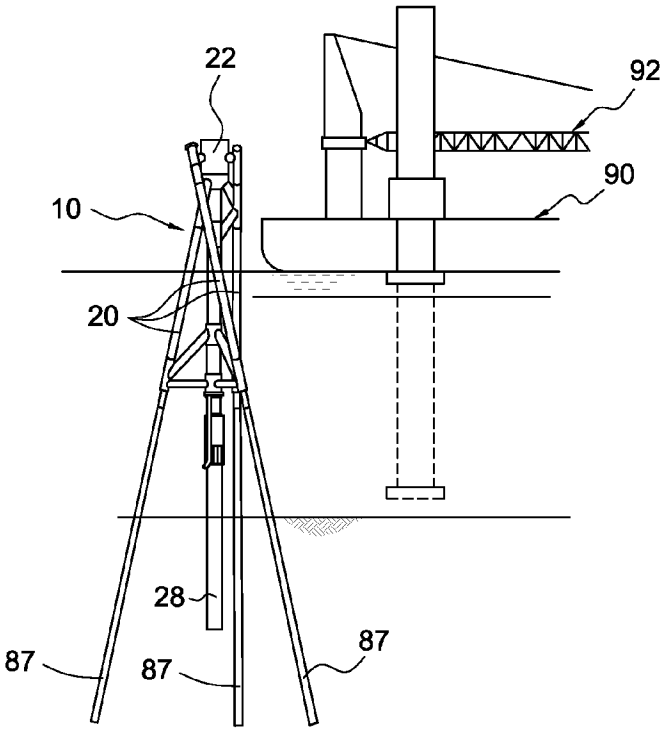
Figure 10H:
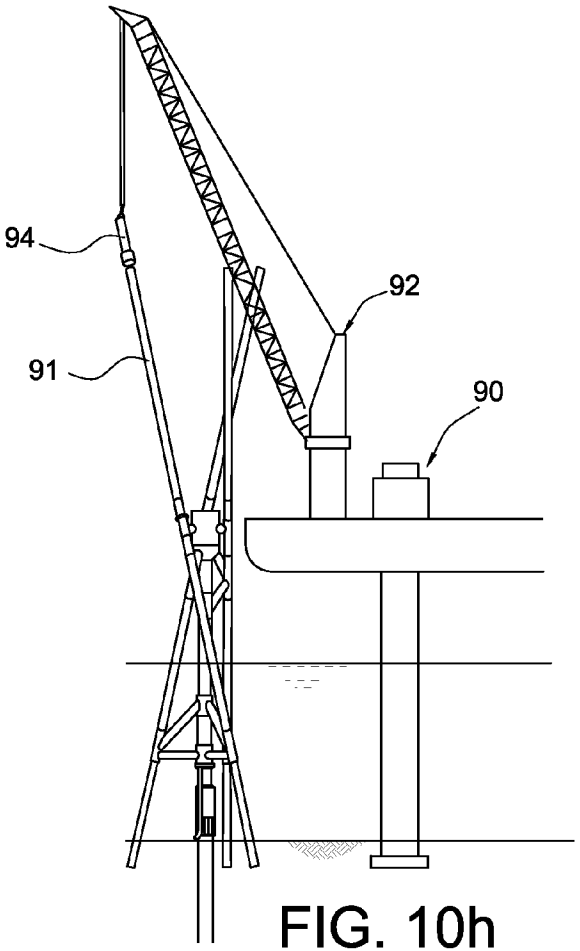

Referring to FIGS. 10*a*-10*i*, assembling and installing support structure 10 begins at an onshore location (FIG. 10*a*) where vertical sleeve 18, transition joint 22, braces 40, 42, 44, 46, 50, and elongated sleeves 20 are connected, i.e. welded, together to form the guide portion of the structure. Platform 52 may also be connected to elongated sleeves 20 and transition joint 22 while onshore. Preferably, a lower pile section 87 is lowered into each of the elongated sleeves 20 while at the onshore assembly location and temporarily secured to the elongated sleeves in a retracted position by a respective gripper 89 mounted on the proximal end of each elongated sleeve 20. In this manner, pile section 87 are installed in the more stable, controlled onshore location thereby reducing the time, cost, and effort required to install the pile sections 87 in the more unpredictable offshore location. One or more support structures 10 are then loaded onto a marine vessel, such as a jack-up barge 90, and transported to the offshore location. The barge 90 is then jacked up so that its legs are securely positioned against the support surface 30 and the barge body lifted above the water level for stability. As shown in FIG. 10*b*, a crane 92 is then used to lift caisson 28 from the barge and lower caisson 28 vertically into the water until its distal end is positioned against the support surface 30, i.e., ocean floor. Next, referring to FIG. 10*c*, a hydraulic hammer 94 is then used to drive caisson 28 into surface 30. After caisson 28 has been driven to a desired depth, as shown in FIG. 10*d*, crane 92 lifts support structure 10 off the deck of barge 90, positions vertical sleeve 18 in alignment above caisson 28 (FIG. 10*d*) and lowers support structure 10 so that caisson 28 extends upwardly into sleeve 18 until sleeve 18 abuts against a stop land 96 formed on caisson 28 (FIG. 10*e*). A support assembly 98 for supporting electrical cables may be mounted on the distal end of sleeve 18 so that when structure 10 is lowered into the final resting position of FIG. 10*e*, the support assembly 98 abuts stop land 96 and a portion of vertical sleeve 18 abuts the proximal end of support assembly 98. The grippers 89 are then operated to release lower pile sections 87 allowing sections 87 to slide, by gravity, through sleeves 20 into an extended position in support surface 30 with the upper portion of lower pile sections 87 maintained inside sleeves 20 (FIG. 101). In the exemplary embodiment, crane 92 then lifts an upper pile section 91 from barge 90 to a position above one of elongated sleeves 20 (FIG. 10*g*) and lowers upper pile section 91 into sleeve 20 until the distal end of upper pile section 91 abuts the proximal end of lower pile section 87 inside sleeve 20. Hydraulic hammer 94 is then supported by crane 92 (FIG. 10*h*) and used to apply a driving force to upper pile section 91, which in turn applies a driving force to the proximal end of lower pile section 87 to drive lower pile section 87 into support surface 30 (FIG. 10*i*). Upper and lower pile sections 91 and 87, respectively, are then connected, i.e. grouted, to one another at the end interface of these sections inside sleeve 20. This process is then repeated for the other elongated sleeves 20. The grouted pile splice connecting upper pile section 91 and lower pile section 87 may include the features and may be performed using the method described in copending U.S. patent application Ser. No. 12/793,230, entitled "Grouted Pile Splice and Method of Forming a Grouted Pile Splice" filed on Jun. 3, 2010, the entire contents of which is hereby incorporated by reference. Thus upper pile sections 91 may include an integral driving head 96 and a stabbing guide 98, and crane 92 may be used to lower a grout line assembly with a stinger tip section into upper pile section 91 to supply grout to connect the piles as fully described in copending U.S. patent application Ser. No. 12/793,230.

It is therefore apparent that there has been provided, in accordance with the present invention, a concrete reinforced spherical head and cylindrical shell tubular joint and method for concreting the lightweight or temporary internal head and shell assembly for the external head and shell tubular joint assembly. While this invention has been described in conjunction with a number of illustrative embodiments, it is evident that many alternatives, modifications, and variations would be or are apparent to those of ordinary skill in the application arts. Accordingly, the disclosure is intended to embrace all such alternatives, modifications, equivalents and variations that are within the spirit and scope of this invention.

I claim:

1. A support structure for supporting an offshore device, comprising:

a vertical member having a vertical longitudinal axis;

a transition joint including a cylindrical portion and a convex portion, said convex portion connected to said vertical member;

the offshore device being mounted on said transition joint;

at least three elongated elements positioned a spaced transverse distance from, and around, said vertical member and the cylindrical and convex portions of the transition joint, each of said elongated elements including a distal end and a proximal portion, said proximal portion positioned closer to the vertical longitudinal axis of said vertical member than said distal end in a direction perpendicular to the vertical longitudinal axis; and at least three upper angled braces each having a longitudinal brace axis positioned at an angle from the vertical longitudinal axis of the vertical member, connected at a first end to a respective one of said elongated elements, and connected at a second end to said convex portion, wherein each longitudinal brace axis extends transverse to both said vertical member and respective one of said at least three elongated elements; and the convex portion is positioned between the cylindrical portion and the vertical member along the vertical longitudinal axis.

2. The support structure of claim 1, wherein said second end of each of said at least three upper angled braces includes an outer circumferential extent connected to said convex portion around an entire circumference of said outer circumferential extent.

3. The support structure of claim 1, wherein said at least three elongated elements include only three elongated elements offset from each other by 120 degrees around said vertical member.

4. The support structure of claim 1, wherein said convex portion is semispherical.

5. The support structure of claim 1, further including at least three upper lateral braces each connected at a first end to a respective one of said elongated elements and at a second end to said cylindrical portion.

6. The support structure of claim 1, wherein said convex portion includes an outer convex surface, each of said at least three angled braces including an outer brace surface, said outer convex surface and said outer brace surface forming a surface angle of at least 45 degrees at connection of the respective angled brace and said convex surface.

7. The support structure of claim 1, wherein each longitudinal brace axis forms a brace support angle of approximately 40 degrees from a respective longitudinal axis of one of said at least three elongated elements.

8. The support structure of claim 1, wherein said transition joint is hollow and includes an inner surface and a strengthening material in contact with said inner surface.

9. The support structure of claim 8, wherein said strengthening material is concrete.

10. The support structure of claim 1, wherein the offshore device is an offshore wind turbine device.

11. A method of assembling and installing a support structure for supporting an offshore device at an offshore location, comprising:

connecting a transition joint to a vertical sleeve member at an onshore location, said transition joint including a cylindrical portion and a convex portion, said convex portion connected to said vertical sleeve member;

connecting at least three elongated sleeve elements to said vertical sleeve member, at the onshore location, using at least three braces;

inserting and temporarily connecting a lower pile into each of said at least three elongated sleeve elements at the onshore location to form a support structure;

transporting the support structure with inserted lower piles from the onshore location to the offshore location;

driving a vertical caisson into a support surface at the offshore location to secure the vertical caisson in a vertical support position;

lowering the support structure onto the vertical caisson with the vertical caisson extending into said vertical sleeve member;

disconnecting each lower pile section from the respective elongated sleeve element;

driving each lower pile section through the respective elongated sleeve into the support surface;

inserting an upper pile section into each of said at least three elongated sleeve elements; and securing each upper pile section to the respective lower pile section.

12. The method of claim 11, wherein the driving of each lower pile section occurs after the inserting of the respective upper pile section, further including applying a driving force to each of the upper pile sections to cause each upper pile section to drive a respective lower pile section into the support surface.

* * * * *